United States Patent [19]

Polman

[11] 4,155,205

[45] May 22, 1979

[54] WINDOW COMPRISING TWO WINDOW PANES WHICH ARE ARRANGED AT A DISTANCE FROM EACH OTHER

[75] Inventor: Jan Polman, Eindhoven, Netherlands

[73] Assignee: U.S. Philips Corporation, New York, N.Y.

[21] Appl. No.: 867,592

[22] Filed: Jan. 6, 1978

[30] Foreign Application Priority Data

Nov. 3, 1977 [NL] Netherlands ..... 7702637

[51] Int. Cl.[2] ..... E06B 7/12

[52] U.S. Cl. ..... 52/171; 52/308; 52/788

[58] Field of Search ..... 52/171, 172, 208, 202, 52/304, 308, 616, 397, 398, 399, 788

[56] References Cited

U.S. PATENT DOCUMENTS

| | | | |
|---|---|---|---|
| 2,291,913 | 8/1942 | Nicolai | 52/398 |
| 2,367,610 | 1/1945 | Randall | 52/399 |

FOREIGN PATENT DOCUMENTS

| | | | |
|---|---|---|---|
| 327625 | 3/1958 | Switzerland | 52/208 |

*Primary Examiner*—James L. Ridgill, Jr.

*Attorney, Agent, or Firm*—Thomas A. Briody; William J. Streeter; Rolf E. Schneider

[57] ABSTRACT

A double-glazed window, in which the intermediate space contains moist air, includes at least one readily heat-conducting element providing exclusive thermal contact between the intermediate space and the outside air. A capillary structure is associated with at least a part of the surface of the end of the element in heat-exchanging contact with the intermediate space.

6 Claims, 6 Drawing Figures

WINDOW COMPRISING TWO WINDOW PANES WHICH ARE ARRANGED AT A DISTANCE FROM EACH OTHER

This invention relates to a window for thermally insulating a space from the outside air, comprising two window panes which are arranged at a distance from each other, an intermediate space which is filled with moist air being present therebetween.

The window panes may be made of glass, but may alternatively be made, for example, of a synthetic plastics material.

In order to improve the thermal insulation of houses and buildings, nowadays double glazing is often used. For already existing houses, the replacement of the single window pane by a system of double glazing is not always economically justified. In such cases the arrangement of a second window pane at the inner side or outer side of the housing may form an attractive solution. However, this has a drawback in that at comparatively low outer ambient temperatures the water vapour present in the air between the two window panes condenses on the inner wall of the window pane facing the outside air. Consequently, the view through the window is disturbed.

The present invention has for its object to provide an improved window of the described kind wherein condensation of moisture on the inner wall of the outer window pane is prevented in a structurally simple and inexpensive manner.

In order to realize this object, the window in accordance with the invention is characterized in that the intermediate space is in thermal contact exclusively with the outside air via at least one element of a readily heat conducting material.

Due to the presence of the suitably heat conductive connection element between the outside air and the intermediate space bounded by the two window panes, the end of this element which is in heat exchanging contact with the intermediate space forms a cold spot on which moisture present in the intermediate space condenses at comparatively low outdoor temperatures, in view of the fact that the mean temperature in the intermediate space is higher than the outdoor temperature.

Preferably, the element is made of a metal, such as copper, or a metal alloy such as brass.

A preferred embodiment of the window in accordance with the invention is characterized in that the end of the element which is in heat exchanging contact with the intermediate space is provided with a capillary structure over at least a part of its surface.

The capillary structure may be formed, for example, by capillary grooves provided in the element surface or by a metal gauze layer provided on this surface.

The capillary structure not only provides a more favourable heat transfer surface area, but also ensures, on the basis of capillary forces and the surface tension of deposited moisture, that the condensate is uniformly distributed over the condensation surface and is retained in the capillary ducts.

A further preferred embodiment of the window in accordance with the invention is characterized in that the end of the element which is in heat exchanging contact with the intermediate space is constructed as a collecting reservoir for condensed moisture.

In accordance with the invention, the element may be passed through the window pane facing the outside air.

It is alternatively possible in accordance with the invention for the element to form part of or be formed by an edge profile arranged around the window pane facing the outside air.

The invention will now be described in detail with reference to the accompanying diagrammatic drawing; in which:

FIG. 1 is a cross-sectional view of a part of a house, including a window with double glazing, a readily heat conducting element being passed through the outer window pane.

FIG. 1*a* shows a further embodiment of the readily heat conducting element.

Figures 1, 1A:
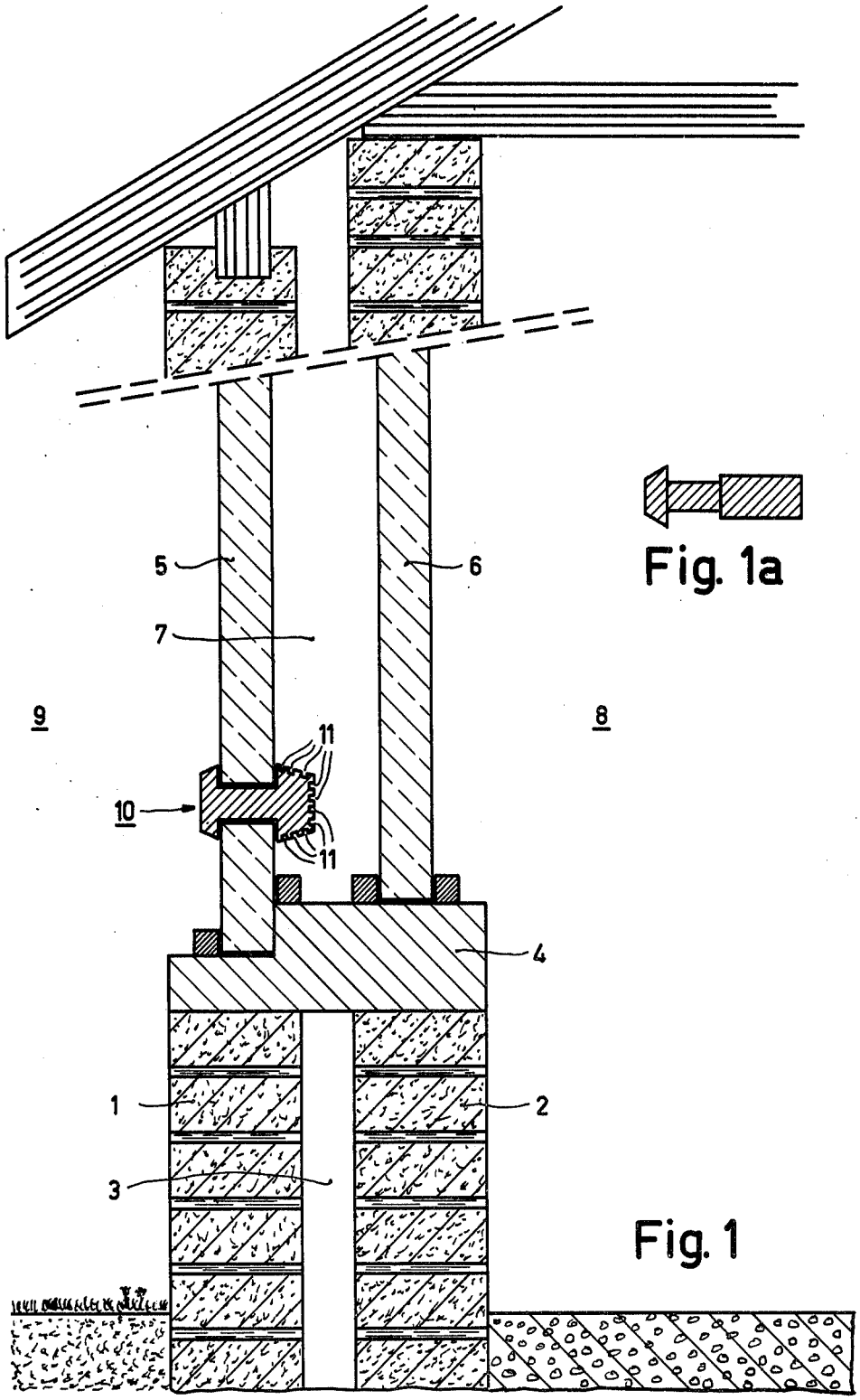

The reference numeral 1 in FIG. 1 denotes an outer wall, and the reference numeral 2 denotes an inner wall of a house, a cavity 3 being present therebetween. In the walls there is provided a wooden window frame 4 in which a glass outer window pane 5 and a glass inner window pane 6 are mounted at a distance from each other. Moist air at atmospheric pressure is present in the intermediate space 7 between the window panes 5 and 6.

In addition to its function as a window, the assembly formed by the window panes 5 and 6 also serves as a heat insulating system for the room 8 with respect to the outside 9.

Through the outer window pane 5 a copper element 10 having excellent thermal conductivity is passed. The part of the element 10 which is situated in the intermediate space 7 is provided with capillary grooves 11.

During periods of the year when the ambient temperature is comparatively low, the part of the element 10 which is situated in the intermediate space 7 forms a cold spot having a temperature which is lower than the temperature level otherwise prevailing in the intermediate space 7 (which in its turn is lower than the temperature level in the room 8). The moisture (water vapour) present in the intermediate space 7 then condenses on the element 10 and is retained in the capillary grooves 11 on the basis of capillary forces, utilizing the surface tension of the condensate. The capillary structure also provides uniform wetting across the entire condensation surface available. Moreover, the heat exchanging surface is increased by the capillary grooves. It is thus achieved that moisture does not condense on the outer window pane 5, so that the window remains transparent. At comparatively high outdoor temperatures, the water evaporates again from the grooves 11, but the water vapour formed does not disturb the view through the window.

FIG. 1*a* shows a readily heat conducting element without capillary grooves.

Figure 2:
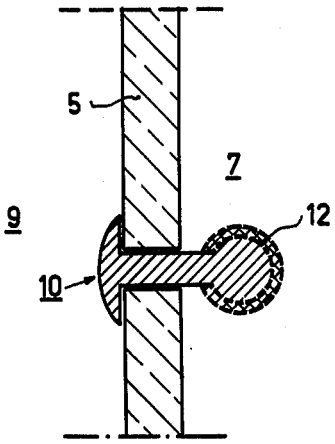
FIGS. 2 and 3 are cross-sectional views of alternatives for the readily heat conducting element passed through the outer window pane of FIG. 1.

The readily heat conducting element 10 in the outer window pane 5 in FIG. 2 has a capillary structure which is provided on the spherical part in the intermediate space 7 and which consists of a layer of copper gauze 12.

Figure 3:
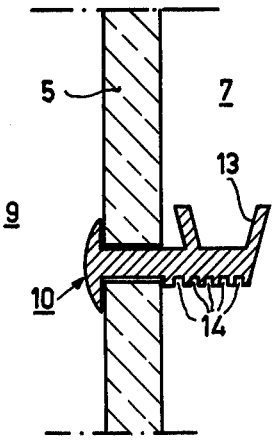

FIG. 3 shows how the part of the element 10 which is situated in the intermediate space 7 is constructed as a collecting reservoir 13 for condensate. The reservoir 13 is provided with capillary grooves 14 on its lower side. Moisture which condenses on the lower side of the reservoir 13 is retained in the grooves 14.

Figure 4:
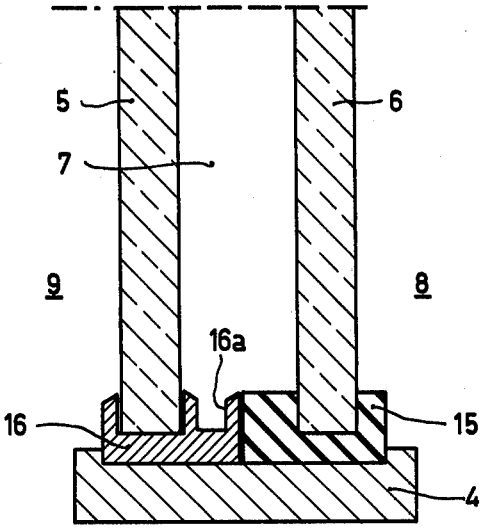
FIG. 4 is a cross-sectional view of a part of a window, the outer window pane of which is provided on its lower side with a readily heat conducting edge profile including a collecting reservoir.

The embodiment of the window shown in FIG. 4 again includes a wooden window frame 4. The inner window pane 6 is mounted in a heat insulating edge profile 15 of a synthetic plastics material. The outer window pane 5 is mounted on its lower side in a readily heat conducting edge profile 16 of, for example, copper or brass which thermally connects the intermediate space 7 to the outside 9. The edge profile 16 includes a portion 16*a* which is situated in the intermediate space 7 and which serves as a collecting reservoir for condensate.

The profile 15 of synthetic plastics material ensures that the edge profile 16 is thermally insulated from the room 8.

At comparatively low ambient temperatures, the edge profile 16 operates in the same manner as described with reference to FIG. 1.

Figure 5:
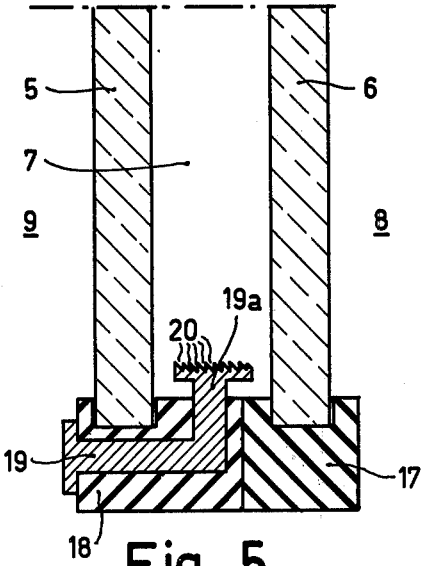
FIG. 5 is a cross-sectional view of a part of a window wherein the intermediate space between the two window panes is in good thermal contact with the outside air by way of a readily heat conducting element which is passed through a heat insulating layer.

The window shown in FIG. 5 comprises an inner window pane 6 which is mounted in edge profile 17 of a synthetic plastics material of low heat conductivity, and an outer window pane 5 which is mounted in an edge profile 18 of a synthetic plastics material of low heat conductivity.

A readily heat conducting element 19 of, for example, copper or aluminium is passed through the edge profile 18 and forms the thermal connection between the outside air 9 and the intermediate space 7. The portion 19*a* of the element 19 which is present in the intermediate space 7 constitutes the condensation surface which is provided with capillary grooves 20.

Obviously, a plurality of suitable thermally conductive elements can be provided as the thermal connection between the intermediate space and the outside air.

What is claimed is:

1. A double-glazed window, which comprises two window panes separated from each other, moist air being present in the intermediate space therebetween, at least one readily heat-conducting element providing exclusive thermal contact between said intermediate space and the outside air, and a capillary structure associated with at least a part of the surface of the end of said element in heat-exchanging contact with the intermediate space.

2. A double-glazed window according to claim 1, in which the end of the element in heat-exchanging contact with the intermediate space includes a reservoir for collecting condensed moisture.

3. A double-glazed window according to claim 1, in which the element passes through the window pane facing the outside air.

4. A double-glazed window according to claim 1, in which the window pane facing the outside air is arranged in an edge profile, and the element is included in said edge profile.

5. A double-glazed window according to claim 1, in which the element is formed of a metal or a metal alloy.

6. A double-glazed window according to claim 5, in which the metal or the metal alloy is respectively copper or brass.

* * * * *